US005363346A

United States Patent [19]

Maltby

[11] Patent Number: 5,363,346

[45] Date of Patent: Nov. 8, 1994

[54] CONFORMING TUNING COUPLER FOR FLEXTENSIONAL TRANSDUCERS

[75] Inventor: John D. Maltby, San Diego, Calif.

[73] Assignee: The United States of America as represented by the Secretary of the Navy, Washington, D.C.

[21] Appl. No.: 1,438

[22] Filed: Jan. 7, 1993

[51] Int. Cl.[5] ..... H04R 17/00

[52] U.S. Cl. ..... 367/163; 367/159; 367/174; 310/337

[58] Field of Search ..... 367/163, 174, 159, 167, 367/172; 310/337

[56] References Cited

U.S. PATENT DOCUMENTS 4,845,687 1/1989 Bromfield ..... 367/158
4,964,106 10/1990 Bromfield ..... 367/165

*Primary Examiner*—J. Woodrow Eldred

*Attorney, Agent, or Firm*—Harvey Fendelman; Thomas Glenn Keough

[57] ABSTRACT

A flextensional transducer includes a stack of driving elements disposed along a linear axis to convert a driving power into vibrational energy. End pieces, disposed at each end of the stack, have outwardly facing arcuate surfaces. A flexural shell, formed into a loop, is disposed to circumscribe the stack and the end pieces to present an elliptical cross-section with the major axis thereof being generally coincident with the stack's linear axis. The shell is reactively coupled to the end pieces at the outwardly facing arcuate surfaces. A pliant assembly is positioned between each end piece and the flexural shell for maintaining conformal engagement between portions of the end pieces and the flexural shell. The pliant assembly is designer such that its stiffness may be adjusted.

60 Claims, 6 Drawing Sheets

CONFORMING TUNING COUPLER FOR FLEXTENSIONAL TRANSDUCERS

STATEMENT OF GOVERNMENT INTEREST

The invention described herein may be manufactured and used by or for the Government of the United States for governmental purposes without the payment of any royalties thereon or therefor.

FIELD OF THE INVENTION

The present invention relates to the field of flextensional transducers, and more particularly to a means for coupling a transducer's driving means to the transducer's vibrating flexural surface in a conformable spring-like fashion such that good coupling efficiency is achieved and such that the stiffness of the coupling means is adjustable to tune the transducer's performance

BACKGROUND OF THE INVENTION

In general, an acoustic transducer converts a driving force into acoustic radiation. Typically, a driving means is supplied with energy and vibrates in response thereto. The vibrating driving means is coupled to a flexural surface which projects the vibrations as acoustic radiation. Accordingly it is important to efficiently couple the driving means with the flexural surface By way of illustrative example, coupling will be described as it pertains to a flextensional transducer. As shown in FIG. 1, a typical flextensional transducer 10 projects acoustic radiation into the ocean using a vibrating shell 12. The device that provides the driving force to vibrating shell 12 is typically an electrically actuated piezoelectric or magnetostrictive ceramic stack driver 14. Stack driver 14 is situated along major axis 100 of transducer 10. The geometry of transducer 10 is designed such that the vibrating shell's resultant displacement across its minor axis 200 is much greater than the displacement of stack driver 14. This amplification, in effect attributable to the shell geometry, is an efficient means of converting the stack's driving power into acoustic radiation. Between each end of stack driver 14 and shell 12 is a coupler component which is typically machined from aluminum in the shape of a "D" and is therefore referred to as a D-insert. D-insert 16 transfers the driving force/displacement of stack driver 14 to shell 12.

In FIGS. 2(*a*) and 2(*b*), a side view of one end of transducer 10 is shown with shell 12 in its undeformed state and deformed state, respectively. The geometry of D-insert 16 is such that its radius of curvature is less than the end radius of the inner surface 12*i* when shell 12 is in its undeformed state. This results in an area of contact between inner surface 12*i* and D-insert 16 as indicated by contact arrows 18. As shell 12 deforms during deflection, its end radius decreases so that the area of contact between inner surface 12*i* and D-insert 16 increases as indicated by contact arrows 18 in FIG. 2(*b*). Note that this also results in an increase in transverse structural support by D-insert 16 to shell 12 as indicated by transverse force arrows 20.

As shell 12 continues to deform to its greatest or worst case deflection, the end radius of inner surface 12*i* can potentially decrease to where it is less than that of the radius of D-insert 16. This results in an adverse condition of a gap 22 forming between inner surface 12*i* and D-insert 16 as shown in FIG. 3. This condition, known as "gapping", sets up an unfavorable coupling condition because shell 12 is only in contact with D-insert 16 at points 24. As a result, shell 12 may pivot about contact points 24 independent of deflection generated by stack driver 14. Thus, coupling efficiency is greatly reduced and may degrade to the point where shell 12 can deflect out-of-phase with the deflections generated by stack driver 14. In addition, owing to the reduced contact area between inner surface 12*i* and D-insert 16 caused by gapping, localized stresses in shell 12 around contact points 24 increase severely.

One solution to gapping is to design D-insert 16 with a radius of curvature that will always be smaller than the worst case deformed state of shell 12. However, while solving the gapping problem, a smaller D-insert offers reduced transverse structural support for shell 12 since the available contact area between the D-insert and the shell is reduced. As mentioned above, a reduced contact area increases localized stresses in shell 12.

Thus, a need exists for a means to improve the coupling between a flextensional transducer's stack driver and flexural shell. Accordingly, it is an object of the present invention to provide a means for efficiently coupling a flextensional transducer's driver to its flexural shell. Another object of the present invention is to provide a means for coupling a stack driver to a flexural shell in a flextensional transducer such that the possibility of gapping is minimized while maintaining sufficient transverse structural support for the shell over a range of shell deflections. Still another object of the present invention is to provide an acoustic transducer with means of coupling the transducer's driving means to the transducer's vibrating flexural surface such that the coupling means may be adjusted to tune the transducer's acoustic performance.

SUMMARY OF THE INVENTION

In accordance with the present invention, a flextensional transducer assembly includes a stack of driving elements disposed along a linear axis to convert a driving power into vibrational energy. End pieces, disposed at each end of the stack, have outwardly facing arcuate surfaces. A flexural shells formed into a loop, is disposed to circumscribe the stack and the end pieces to present an elliptical cross-section with the major axis thereof being generally coincident with the stack's linear axis. The shell is reactively coupled to the end pieces at the outwardly facing arcuate surfaces. In general, a pliant assembly is positioned between each end piece and the flexural shell for maintaining conformal engagement between portions of the end pieces and the flexural shell. More specifically, in a preferred embodiment, the pliant assembly is formed from increasing length plates stacked on one another. The plates are further fixed to one another at a central portion thereof such that adjacent plates are free to slide against one another as the assembly flexes about the central portion. The plate having the greatest length in each assembly is in contact with the shell. The central portion is generally coincident with the major axis of the stack of driving elements. Each plate is further provided with channels extending therealong generally perpendicular to the major axis. Further, a plurality of shims may be inserted in selected channels to adjust the stiffness of the pliant assembly.

The foregoing described invention has the following advantages. In contrast to the current D-insert coupler design, the pliant assembly conforms to a deforming flexural shell to prevent the occurrence of gapping, thereby reducing overall shell stresses and maintaining good coupling efficiency throughout the shell's range of deflection. The contact area is maintained constant regardless of the shell deflection, although the magnitude of transverse contact force is proportional to the degree which the shell has been deflected and the intensity of the assembly's stiffness. By also being able to judiciously adjust the stiffness of the assembly, transverse shell support can be maximized to reduce shell stresses, up to the point at which the desired frequency response of the system is not adversely affected, or to the point at which gapping will occur (because the assembly is too stiff). Since the degree of transverse support can strongly effect the system's overall frequency response, it is also possible to adjust the assembly's stiffness to tune the acoustic performance (i.e., resonance characteristics) of the transducer. In selecting the optimum stiffness, these objectives could possibly compete with each other, and one might take preference over the other depending on the conditions at which the transducer is driven.

DESCRIPTION OF THE DRAWINGS

FIG. 2(*b*) is a side view of one end of the transducer shown in FIG. 1 with its shell in a deformed state;

DESCRIPTION OF THE PREFERRED EMBODIMENTS

Figure 1:
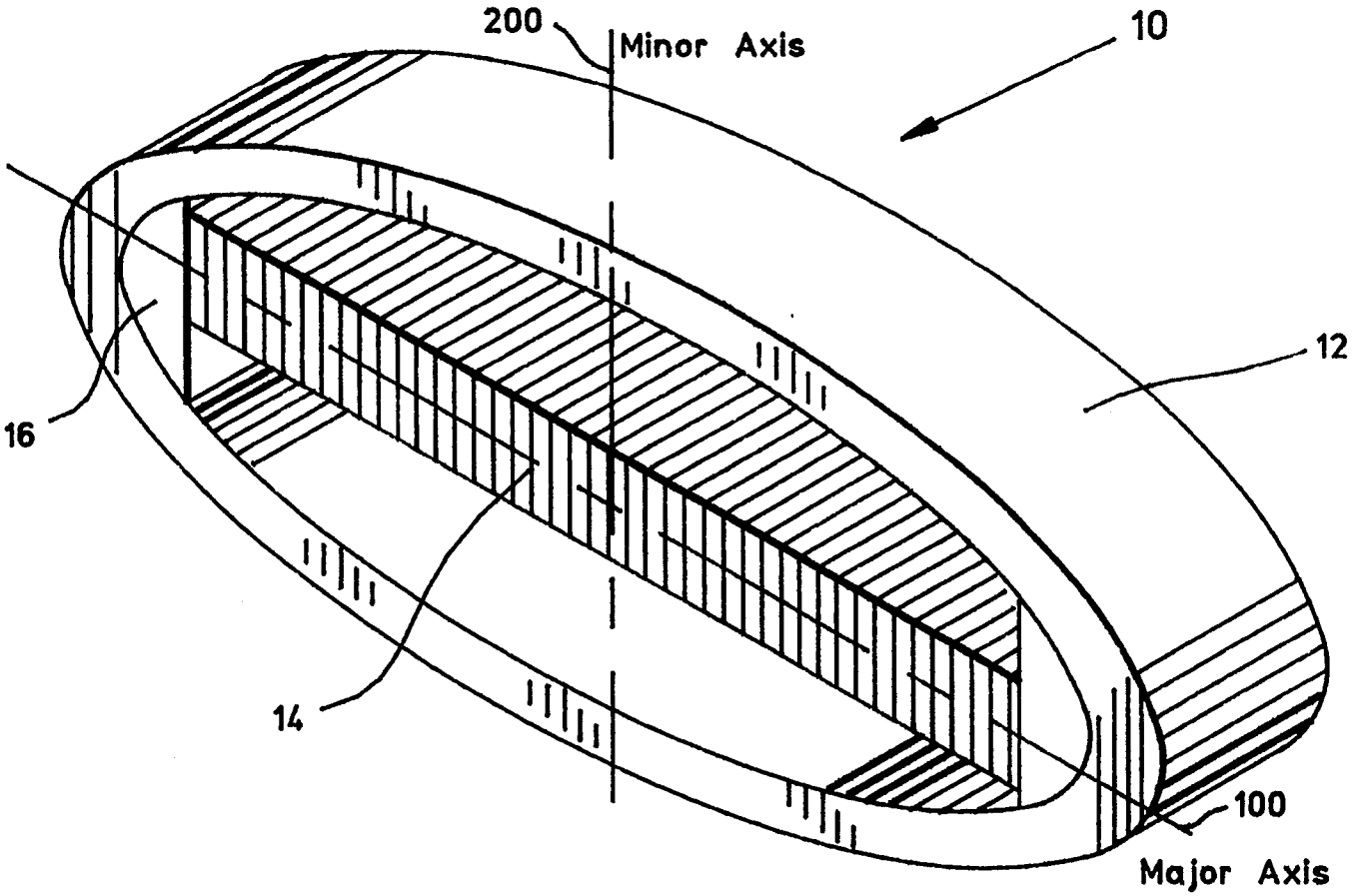
FIG. 1 (PRIOR ART)
FIG. 1 is a perspective, side view of a conventional prior art flextensional transducer.
Figure 2B:
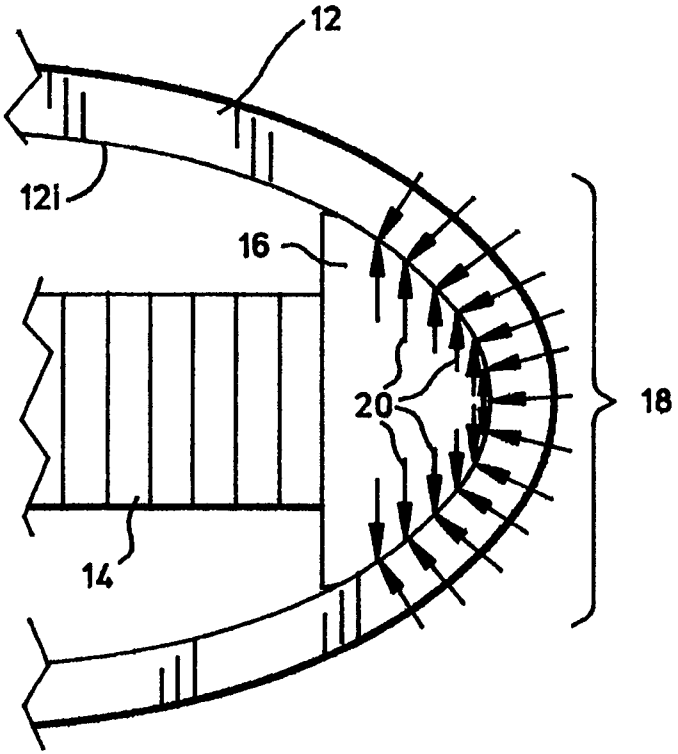
FIG. 2(b) (PRIOR ART)
FIG. 2(*a*) is a side view of one end of the transducer shown in FIG. 1 with its shell in an undeformed state.
Figure 2A:
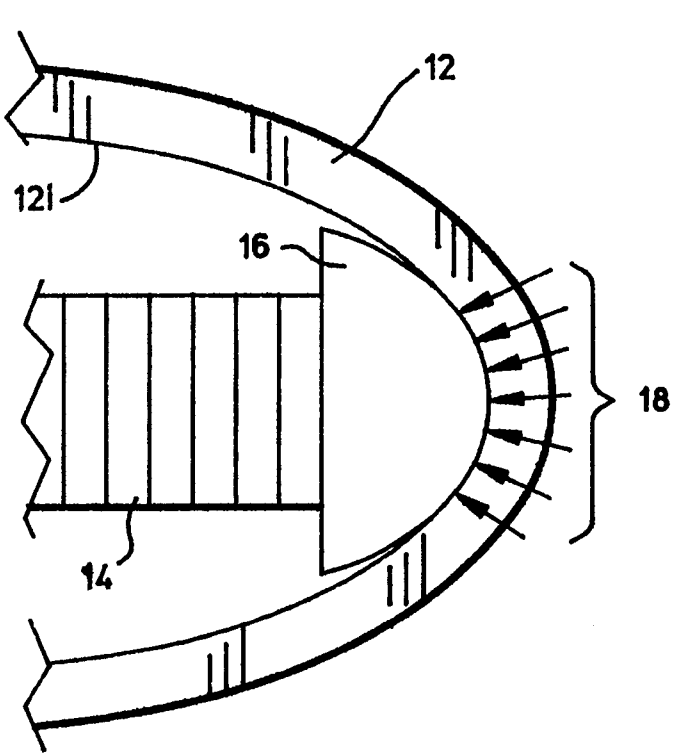
FIG. 2(a) (PRIOR ART)
Figure 3:
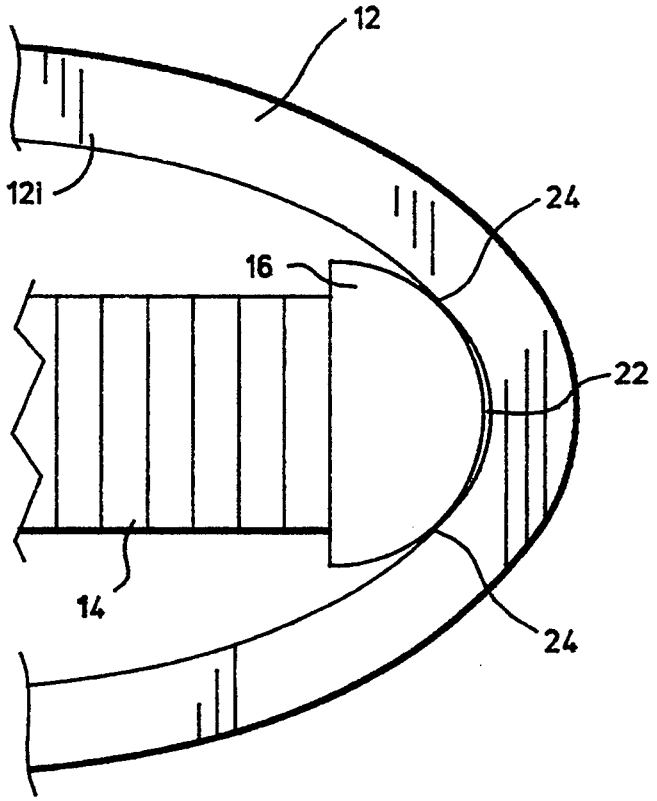
FIG. 3 (PRIOR ART)
FIG. 3 is a side view of one end of the transducer shown in FIG. 1 with its shell deformed to the point that gapping occurs.
Figure 4:
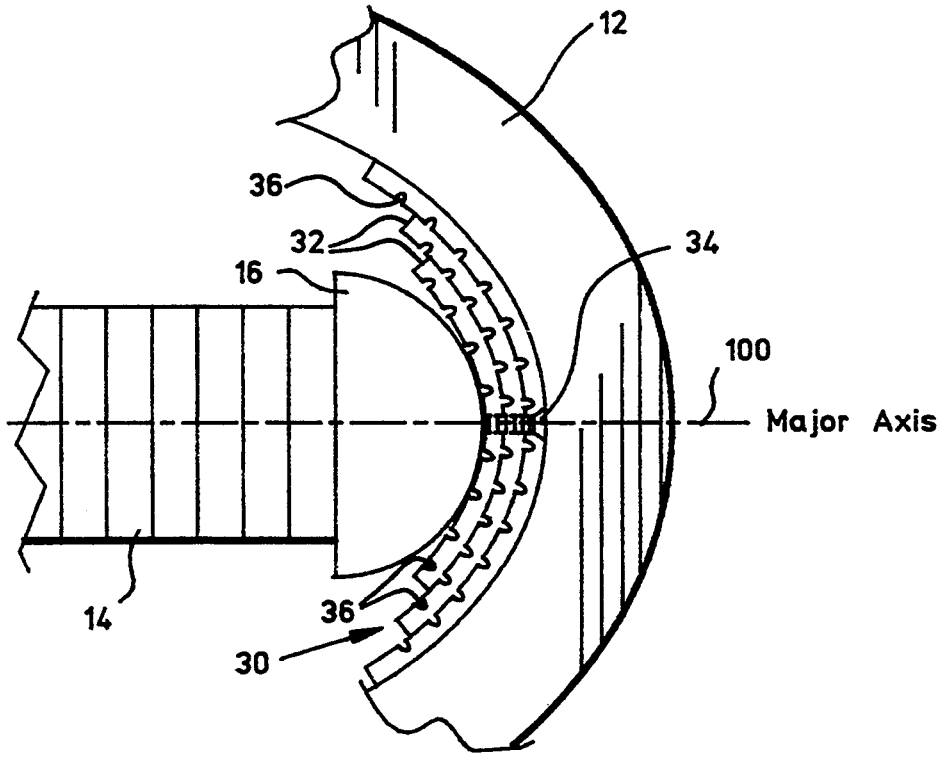
FIG. 4 is a side view of one end of a flextensional transducer that includes the preferred embodiment conforming tuning coupler according to the present invention.

Referring now to the drawings, and in particular to FIG. 4, a preferred embodiment of a conforming tuning coupler 30 according to the present invention is shown. Similar to FIGS. 2(*a*), 2(*b*) and 3, FIG. 4 is a side view of one end of a flextensional transducer 10. However, it will be readily appreciated by one of ordinary skill in the art that the conforming tuning coupler of the present invention may be easily adapted to other transducer designs without departing from the teachings of the present invention. For consistency of description, like reference numerals will be used for those elements that are common to the prior art transducers shown in FIGS. 1–3.

In FIG. 4, coupler 30 is constructed of several independent plates 32 stacked on top of one another and fastened together at the midplane of symmetry as by a fastening bolt 34. Alternatively, bolt 34 may be replaced by other bonding means well known in the art. Positioned between shell 12 and D-insert 16, coupler 30 is biased with spring-like action to conform to the shape of shell 12 as adjacent plates 32 are free to slide on one another. Vibrational load is transmitted from stack driver 14 through D-insert 16 into coupler 30.

Figure 5:
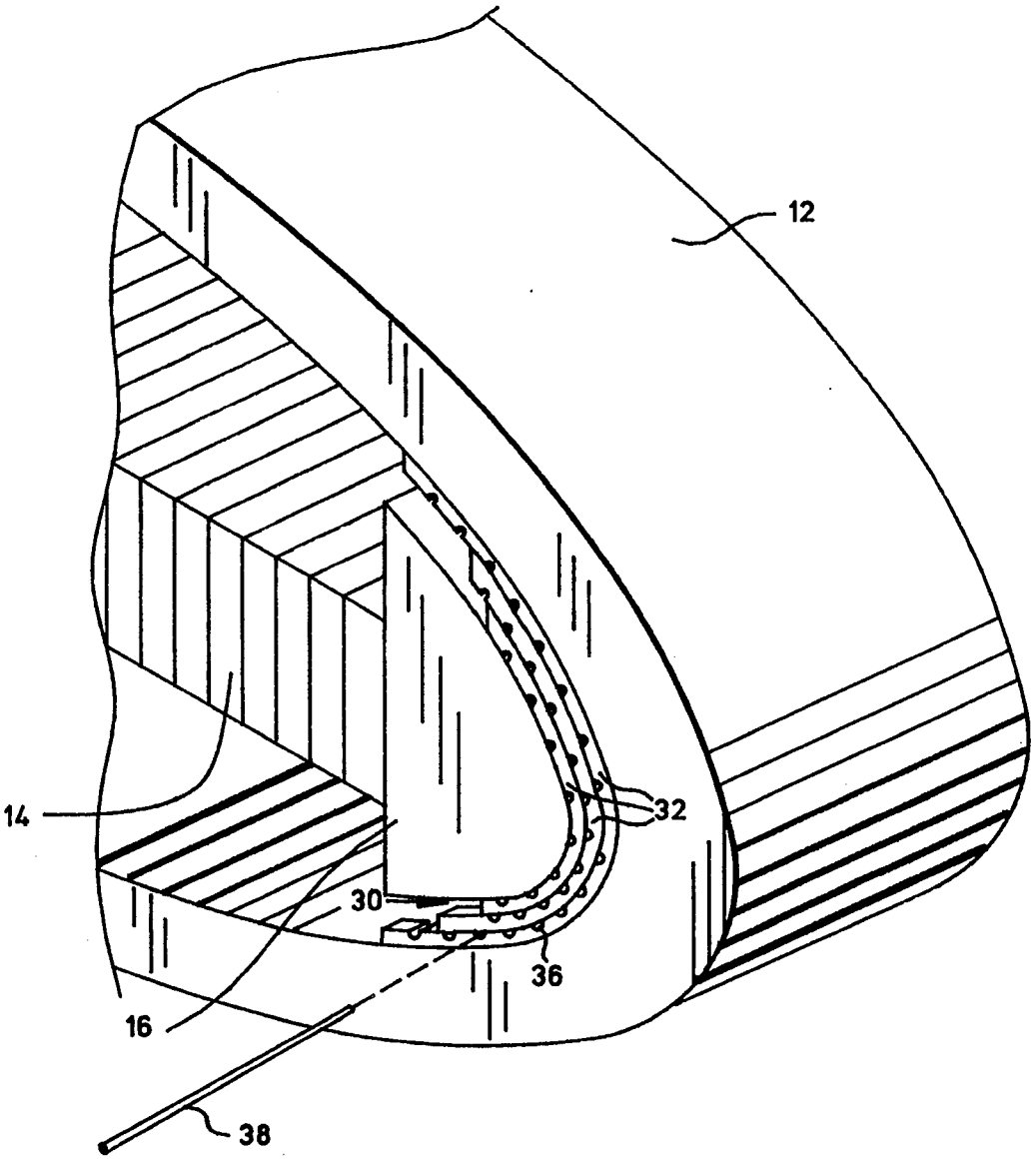
FIG. 5 is a perspective view of one end of the flextensional transducer that indicates the placement of stiffening shims in the conforming tuning coupler according to the preferred embodiment of the present invention.

Each plate 32 is provided with a plurality of channels 36 that extend across each plate in a direction that is generally perpendicular with respect to major axis 100 and further, are open to face towards D-insert 16. Inclusion of channels 36 facilitates the bending of each plate 32. In order to adjust the stiffness of plates 32 (and coupler 30), rigid shims 38 may be selectively inserted into certain channels 36 as shown in the perspective view of FIG. 5. Typically, shims 38 and channels 36 are tapered for easy insertion and shaped to allow an interference fit therebetween once inserted. In this way, the overall stiffness of coupler 30 is determined by the number of shims 58 that are installed. Plates 32 and shims 38 should be made from a high-strength material. By way of a non-limiting example, plates 32 and shims 38 could typically be made from high-strength spring steel.

Due to the symmetry of operation of a flextensional transducer, the midplane of symmetry of coupler 30 is aligned coincidentally along major axis 100 of transducer 10. Furthermore, channels 36 must be balanced about major axis 100 as shown. Similarly, placement of shims 38 should be symmetrical about major axis 100.

Under extreme deflection of shell 12, it is conceivable that coupler 30 would be "tuned" (using shims 38) to be too stiff thereby causing the aforementioned gapping condition to occur. To avoid this problem, the minimum radius of a fully deformed coupler 30 must be designed to be less than the inner radius of shell 12 at its worst case deflection. Note that this solution to the gapping problem is similar in nature to a reduced radius D-insert. However, the leaf spring construction permits the longest length plate to provide the necessary transverse structural support for shell 12 throughout the operating range of transducer 10.

Various alternative configurations to this invention are possible while still providing the main features of (i) conforming to a deforming flextensional shell to prohibit the occurrence of a gapping condition while (ii) maintaining substantial transverse support to the shell to reduce shell stresses and positively effect acoustic performance and (iii) being of readily modifiable stiffness. An important consideration for any alternative design is that its conforming assembly provide a very high energy density in order to work properly.

Figure 6:
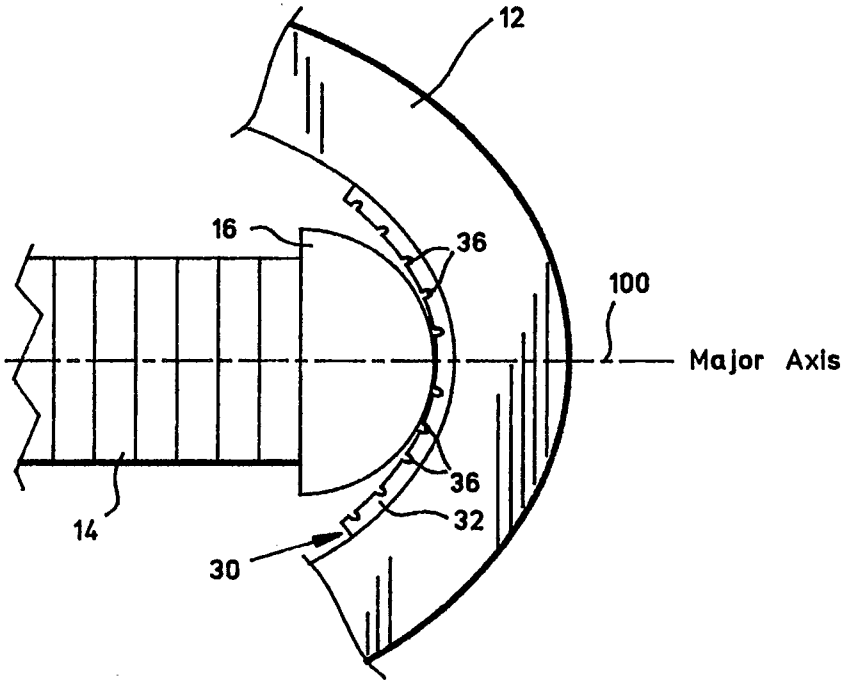
FIG. 6 is a side view of one end of the flextensional transducer that includes an alternative embodiment of the conforming tuning coupler.

One such simple alternative is shown in FIG. 6 where coupler 30 consists of a single plate 32 provided with channels 36 for holding stiffening shims (not shown). The single plate design may be applicable for a flextensional transducer operating in a narrow range of shell deflection.

Figure 7:
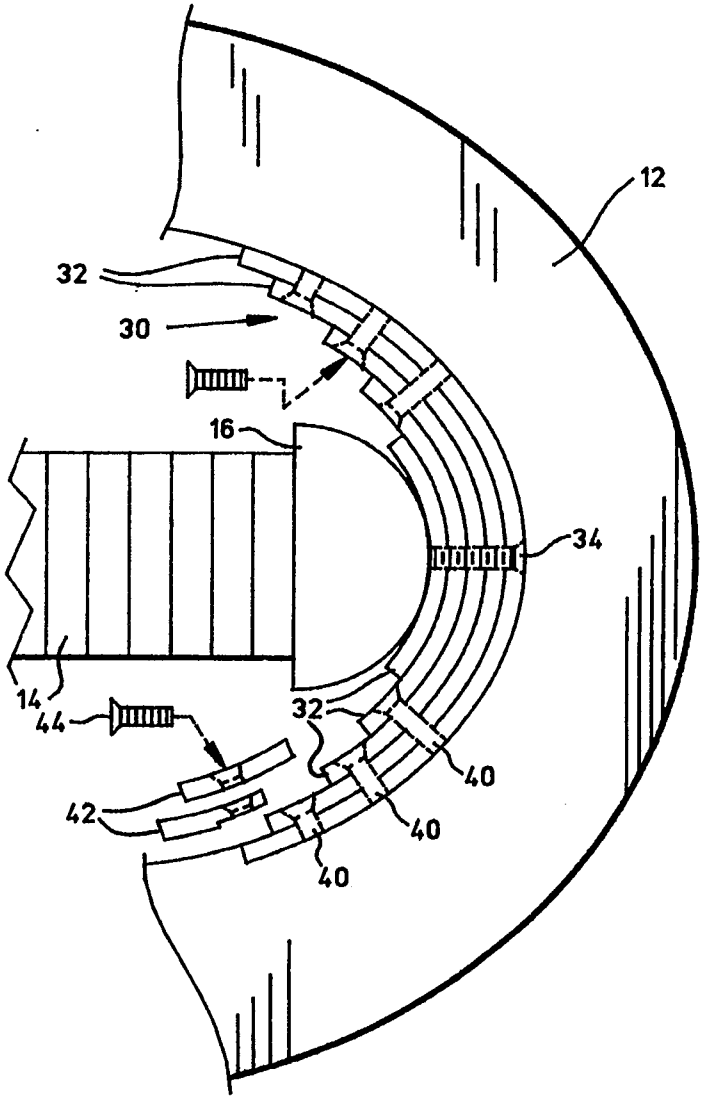
FIG. 7 is a side view of one end of the flextensional transducer that includes another alternative embodiment of the conforming tuning coupler.

Another alternative, shown in FIG. 7, is similar in design to the preferred embodiment. However, in this embodiment, stiffness of the coupler is determined by the number and placement of fasteners 44 that are inserted into fastener passageways 40 which, by judicious placement, inhibit independent movement of plates 32. In addition, dramatic increases in the coupler's stiffness can be made by attaching additional plates 42 to plates 32 with fasteners 44 to effectively increase plate length. In this way, transverse structural support of shell 12 is also increased.

Figure 8:
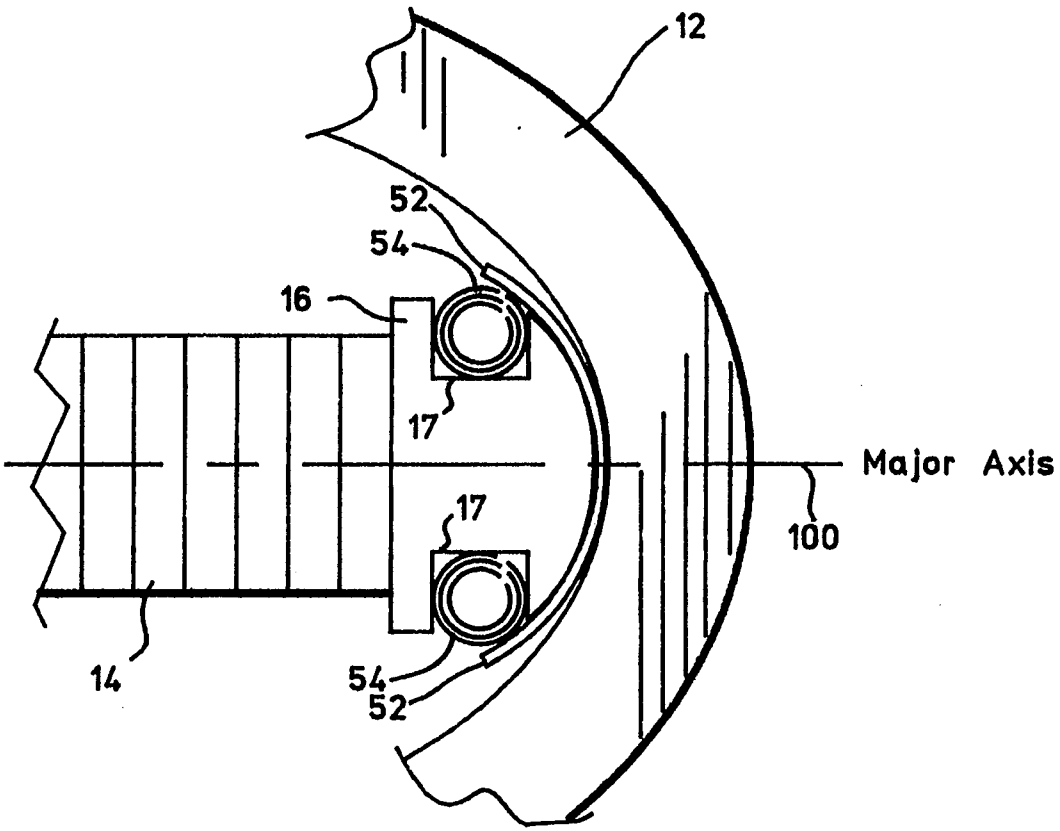
FIG. 8 is a side view of one end of the flextensional transducer that includes yet another alternative embodiment of the conforming tuning coupler.

Yet another alternative design is shown in FIG. 8. In this embodiment, the coupler is constructed from an elastic load-bearing plate 52 that is biased in a spring-like fashion against shell 12 by split-tube springs 54 housed in recesses 17 of D-insert 16 and extends in a direction along plate 52 that is generally perpendicular with respect to major axis 100. Stiffness of the coupler assembly in this embodiment is increased by inserting successively smaller diameter split-tubes 54. Each inserted split-tube 54 is sized to form an interference fit with the next successively larger split-tube.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A flextensional transducer comprising:

means for converting supplied energy into vibrational energy;

a flexural surface, having arcuate portions, operably coupled to said converting means to receive said vibrational energy and to flex in response thereto to transmit an acoustic wave, said flexural surface thus having both static and flexing states;

a pliant assembly positioned between said converting means and said flexural surface, said pliant assembly having arcuate portions biased in spring-like conformal engagement with said flexural surface arcuate portions during both said static and flexing states of said flexural surface; and said pliant assembly including means for adjusting the stiffness thereof extending substantially along the entire length of said pliant assembly arcuate portions.

2. A transducer as in claim 1 wherein said pliant assembly comprises a plate, and said adjusting means comprises a plurality of channels extending along said plate.

3. A transducer as in claim 2 wherein said adjusting means further comprises at least one rigid shim interested into at least a portion of one of said plurality of channels.

4. A transducer as in claim 1 wherein said pliant assembly comprises a plurality of plates stacked on one another and fixed to one another at a central portion thereof wherein adjacent plates are free to slide against one another as said plates flex about said central portion, at least one of said plates being further provided with a plurality of channels extending therealong.

5. A transducer as in claim 4 wherein said adjusting means comprises at least one rigid shim inserted into at least a portion of at least one of said channels.

6. A flextensional transducer comprising:

a stack of driving elements disposed along a linear axis, said stack converting a driving power into vibrational energy;

end pieces disposed at each end of said stack, said end pieces having outwardly facing arcuate surfaces;

a flexural shell formed into a loop and disposed to circumscribe said stack and said end pieces to present an elliptical cross-section with the major axis thereof being generally coincident with said linear axis, and with said shell being reactively coupled to said end pieces at said outwardly facing arcuate surfaces, said flexural shell having arcuate portions, and having both a static and a flex state;

a pliant assembly positioned between each of said end pieces and said flexural surface, each said pliant assembly having arcuate portions biased in spring-like conformal engagement with said flexural surface arcuate portions during both said static and flexing states of said flexural surface; and said pliant assembly including means for adjusting the stiffness thereof extending substantially along the entire length of said pliant assembly arcuate portions.

7. A transducer as in claim 6 wherein said pliant assembly comprises a plate that flexes to conform to the shape of said outwardly facing arcuate surfaces, said stiffness adjusting means comprising channels extending along said plate.

8. A transducer as in claim 7 wherein said channels are open to face said outwardly facing arcuate surfaces.

9. A transducer as in claim 7 wherein said adjusting means comprise at least one rigid shim selectively inserted into at least a portion of one of said channels.

10. A transducer as in claim 6 wherein said pliant assembly comprises a plurality of plates stacked on one another and fixed to one another at a central portion thereof wherein adjacent plates are free to slide against one another as said plates flex about said central portion, said stiffness adjusting means comprising channels in said plates extending generally perpendicular to said major axis.

11. A transducer as in claim 10 wherein said central portion is generally coincident with said major axis.

12. A transducer as in claim 10 wherein said channels are open to face said outwardly facing arcuate surfaces.

13. A transducer as in claim 10 wherein said adjusting means comprises at least one rigid shim selectively inserted into at least a portion of one of said channels.

14. A flextensional transducer comprising:

a stack of driving elements disposed along a linear axis, said stack converting a driving power into vibrational energy;

end pieces disposed at each end of said stack, said end pieces having outwardly facing arcuate surfaces;

a flexural shell formed into a loop and disposed to circumscribe said stack and said end pieces to present an elliptical cross-section with the major axis thereof being generally coincident with said linear axis, said shell being reactively coupled to said end pieces at said outwardly facing arcuate surfaces; and a pliant assembly positioned between each of said end pieces and said shell in conformal engagement with portions of said end pieces and said flexural shell, each assembly being formed from increasing length plates stacked on one another.

15. A transducer as in claim 14 wherein said plates are fixed to one another.

16. A transducer as in claim 14 wherein said plates are fixed to one another at a central portion thereof.

17. A transducer as in claim 16 wherein adjacent plates are free to slide against one another as said assembly flexes about said central portion.

18. A transducer as in claim 14 wherein the greatest length plate in each assembly is in contact with said shell.

19. A transducer as in claim 16 wherein said central portion is generally coincident with said major axis.

20. A transducer as in claim 14 wherein each of said plates is further provided with channels extending therealong generally perpendicular to said major axis.

21. A transducer as in claim 15 wherein the greatest length plate in each assembly is in contact with said shell.

22. A transducer as in claim 17 wherein said central portion is generally coincident with said major axis.

23. A transducer as in claim 15 wherein each of said plates is further provided with channels extending therealong generally perpendicular to said major axis.

24. A transducer as in claim 16 wherein the greatest length plate in each assembly is in contact with said shell.

25. A transducer as in claim 16 wherein each of said plates is further provided with channels extending therealong generally perpendicular to said major axis.

26. A transducer as in claim 17 wherein the greatest length plate in each assembly is in contact with said shell.

27. A transducer as in claim 17 wherein each of said plates is further provided with channels extending therealong generally perpendicular to said major axis.

28. A transducer as in claim 26 wherein said central portion is generally coincident with said major axis.

29. A transducer as in claim 26 wherein each of said plates is further provided with channels extending therealong generally perpendicular to said major axis.

30. A transducer as in claim 28 wherein each of said plates is further provided with channels extending therealong generally perpendicular to said major axis.

31. A transducer as in claim 20 further comprising a plurality of shims inserted in selected ones of said channels to adjust the stiffness of said pliant assembly.

32. A transducer as in claim 23 further comprising a plurality of shims inserted in selected ones of said channels to adjust the stiffness of said pliant assembly.

33. A transducer as in claim 25 further comprising a plurality of shims inserted in selected ones of said channels to adjust the stiffness of said pliant assembly.

34. A transducer as in claim 27 further comprising a plurality of shims inserted in selected ones of said channels to adjust the stiffness of said pliant assembly.

35. A transducer as in claim 29 further comprising a plurality of shims inserted in selected ones of said channels to adjust the stiffness of said pliant assembly.

36. A transducer as in claim 30 further comprising a plurality of shims inserted in selected ones of said channels to adjust the stiffness of said pliant assembly.

37. A transducer as in claim 20 wherein said channels are open to face said outwardly facing arcuate surfaces.

38. A transducer as in claim 23 wherein said channels are open to face said outwardly facing arcuate surfaces.

39. A transducer as in claim 25 wherein said channels are open to face said outwardly facing arcuate surfaces.

40. A transducer as in claim 27 wherein said channels are open to face said outwardly facing arcuate surfaces.

41. A transducer as in claim 29 wherein said channels are open to face said outwardly facing arcuate surfaces.

42. A transducer as in claim 30 wherein said channels are open to face said outwardly facing arcuate surfaces.

43. A transducer as in claim 31 wherein said channels are open to face said outwardly facing arcuate surfaces.

44. A transducer as in claim 36 wherein said channels are open to face said outwardly facing arcuate surfaces.

45. A transducer as in claim 14 wherein each of said plates is made of high-strength spring steel.

46. A transducer as in claim 31 wherein each of said shims is made of high-strength spring steel.

47. A transducer as in claim 31 wherein each of said plates and said shims is made of high-strength spring steel.

48. A transducer as in claim 14 wherein said pliant assembly is spring-like.

49. A flextensional transducer comprising:

a transducer for converting supplied energy into vibrational energy;

a flexural surface, having arcuate portions, operably coupled to said transducer to receive said vibrational energy and to flex in response thereto to transmit an acoustic wave, said flexural surface thus having both static and flexing states;

a pliant assembly positioned between said converting means and said flexural surface, said pliant assembly having arcuate portions biased in spring-like conformal engagement with said flexural surface arcuate portions during both said static and flexing states of said flexural surface; and a spring in contact with said pliant assembly and said transducer for maintaining contact between said flexural surface and said pliant assembly during both said static and flexing states of said flexural surface.

50. The flextensional transducer of claim 49 wherein said spring comprises at least on split ring.

51. The flextensional transducer of claim 50 wherein said spring comprises a plurality of split rings.

52. The flextensional transducer of claim 50 wherein:

said transducer array comprises a stack of driving elements having first and second ends, and further comprises first and second end pieces disposed at said first and second ends; at least one of said end pieces includes at least one channel therein, said split ring being positioned within said channel.

53. The flextensional transducer of claim 51 wherein:

each said end piece has first and second channels therein; and at least one said split ring is positioned in each said channel.

54. The flextensional transducer of clam 53 wherein: a plurality of concentric split rings are positioned in at least one channel.

55. A flextensional transducer comprising:

a transducer for converting supplied energy into vibrational energy;

a flexural surface, having arcuate portions, operably coupled to said transducer to receive said vibrational energy and to flex in response thereto to transmit an acoustic wave, said flexural surface thus having both static and flexing states;

a spring positioned between said transducer and said flexural surface, said spring having arcuate portions based in conformal engagement with said flexural surface arcuate portions during both said static and flexing states of said flexural surface.

56. The flextensional transducer of claim 55 wherein: said spring comprises at least one arcuate plate.

57. The flextensional transducer of claim 56 wherein: said spring comprises a plurality of arcuate plates positioned one on top of the other.

58. The flextensional transducer of claim 57 wherein: at least one of said plurality of plates is provided with means for adjusting the spring stiffness thereof.

59. The flextensional transducer of claim 58 wherein: said means for adjusting comprises a plurality of channels extending along said plate.

60. The flextensional transducer of claim 56 wherein said spring comprises: first and second arcuate plates, each positioned between one end of said transducer and said flexural surface; and at least one split ring positioned between one end of said transducer and one of said arcuate plates.

* * * * *